US005722471A

United States Patent [19]

Fredrickson

[11] Patent Number: 5,722,471

[45] Date of Patent: Mar. 3, 1998

[54] TOOL FOR ROCK BREAKING AND LOG SPLITTING

[76] Inventor: David F. Fredrickson, 4951 Toll Bridge Rd., Belton, Tex. 76513

[21] Appl. No.: 802,613

[22] Filed: Feb. 19, 1997

[51] Int. Cl.[6] ..... B27L 7/00

[52] U.S. Cl. ..... 144/193.1; 125/23.01; 125/40; 144/195.5; 144/195.7; 173/130

[58] Field of Search ..... 269/290; 408/155 R, 408/241 B; 125/23.01, 24, 36, 40; 144/193.1, 195.2, 195.5, 195.7, 195.8, 366; 173/128, 130; 254/104

[56] References Cited

U.S. PATENT DOCUMENTS

| | | | |
|---|---|---|---|
| 4,362,194 | 12/1982 | Lawson | 144/195.5 |
| 4,740,117 | 4/1988 | Deleury et al. | 408/241.8 |
| 5,535,795 | 7/1996 | Bunn | 144/195.8 |
| 5,638,805 | 6/1997 | Li | 125/140 X |

FOREIGN PATENT DOCUMENTS

| | | | |
|---|---|---|---|
| 108531 | 9/1939 | Australia | 144/195.6 |

*Primary Examiner*—W. Donald Bray
*Attorney, Agent, or Firm*—Merek & Voorhees

[57] ABSTRACT

A tool 10 for rock breaking, log splitting and similar operations includes a plate 12 having a plurality of identical apertures 14 formed therethrough. A frame 16 comprised of a skirt 18 formed from lengths of angle iron and a plurality of legs also formed from lengths of angle iron supports the plate 12 in a substantially horizontal orientation above a workpiece. An implement 22 includes a first end for engaging the workpiece and a second end to be engaged with a hammer. The implement is further characterized by dimensions closely matched to those of the apertures formed in the plate. The plate 12 positions the implement 22 in engagement with the workpiece and maintains the implement 22 in a substantially vertical orientation for engagement by an actuating hammer.

6 Claims, 2 Drawing Sheets

TOOL FOR ROCK BREAKING AND LOG SPLITTING

TECHNICAL FIELD

This invention relates generally to hand tools and, more particularly, to a tool adapted to quickly and easily break rocks, excavate holes in rocky ground, split logs and perform other similar tasks.

BACKGROUND AND SUMMARY OF THE INVENTION

Homeowners, contractors, surveyors, utility workers, landscapers, gardeners, farmers, ranchers, etc. are frequently confronted with tasks such as rock breaking, excavation of holes or depressions in rocky ground, log splitting, and the like. Heretofore such tasks have been complicated by difficulties in repeatedly engaging a tool with a selected area of the workpiece or work area. Thus, except in the hands of the experts, tools such as picks, axes, and the like can be difficult to engage with a selected area of the workpiece or work area on a repeated basis.

The present invention overcomes the foregoing and other difficulties associated with the prior art. In accordance with the broader aspect of the invention, a plate is provided with the plurality of apertures. The apertures are sized to closely match the dimensions of a selected implement, which is received through a selected aperture in the plate. The plate is supported and maintained in a substantially horizontal orientation by a plurality of legs. In this manner the implement is aligned with a particular portion of the workpiece while being repeatedly struck with a hammer or repeatedly raised and dropped, thereby achieving the desired result. Among the advantages to the device is its ability to facilitate the optimization of expended physical force by the operator by functioning as a guide for directing the expended force directly to the desired position on the workpiece. This guide function enables repeated impact in the same area of the workpiece.

BRIEF DESCRIPTION OF DRAWINGS

A more complete understanding of the invention may be had by reference to the following Detailed Description when taken in conjunction with the accompanying Drawings, wherein.

DETAILED DESCRIPTION

Figure 1:
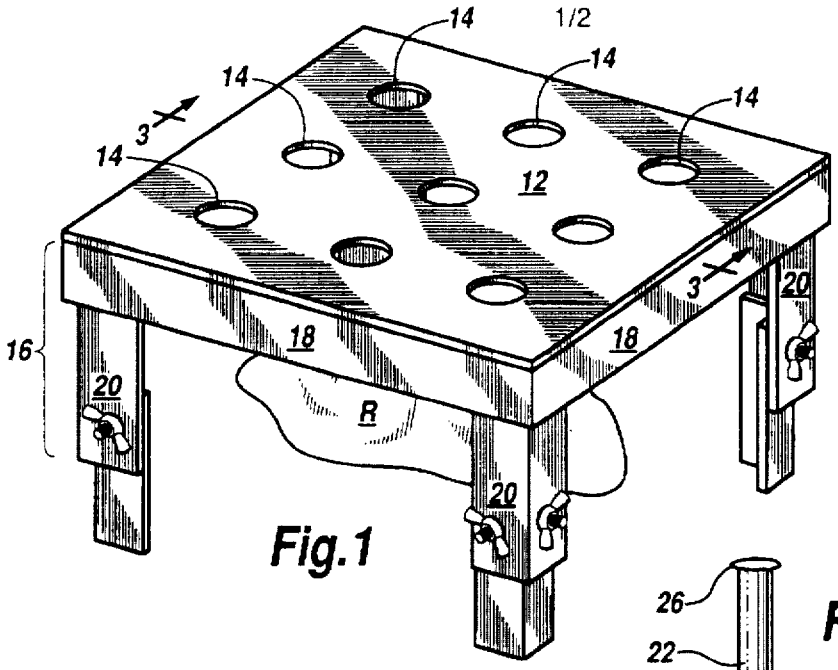
FIG. 1 is a perspective view of a tool for rock breaking, excavation of holes in rocky ground, and log splitting incorporating the present invention.
Figure 3:
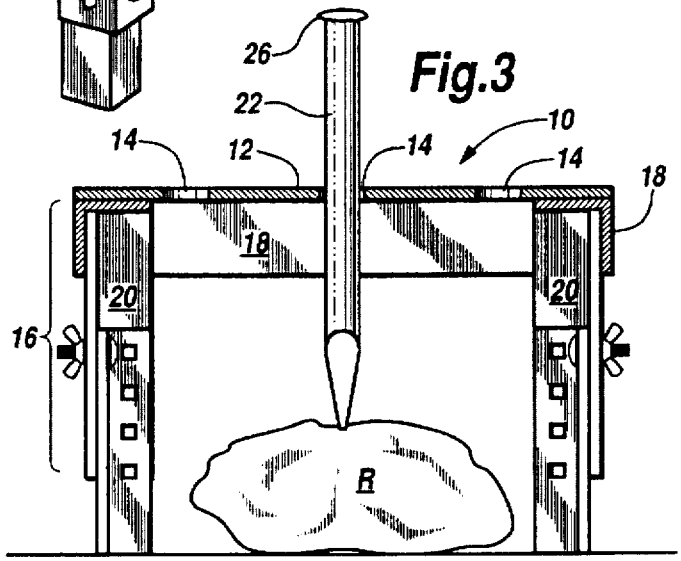
FIG. 3 is a cross sectional view taken through FIG. 1.

Referring now to the Drawings, and in particular to FIGS. 1 and 3 thereof, there is shown a tool for rock breaking, excavation of holes or depressions in rocky ground, log splitting, and similar tasks incorporating the present invention. The tool of the present invention is especially suited for excavating holes in ground having hard sub-surface material. Once the hard material is broken into manageable sized pieces the broken material can be removed by conventional tools such as spades or shovels. The present invention is especially suited to use where it is impossible or impractical to use conventional excavation machinery such as backhoes or jackhammers due to space limitations, environmental restrictions, remoteness of the location or simply cost.

The tool 10 comprises a plate 12 which is preferably formed from steel, cast iron, or other similar, durable material. The plate 12 may range from ⅛" to 1" thickness depending on the material selected. Alternatively, the plate 12 may comprise two or more spaced apart relatively thin plates which are maintained in a predetermined spaced apart relationship by appropriate spacers. The plate should have sufficient strength to function as a secondary impact area.

The plate 12 is provided with a plurality of apertures 14. In the embodiment of the invention illustrated in the Drawings, the apertures 14 are arranged in a checkerboard pattern. However, as will be appreciated by those skilled in the art, the invention is not limited to a particular arrangement of the apertures 14. Rather, the apertures 14 may be arranged in a circular pattern or any other pattern in accordance with the requirements of particular applications of the invention. In an alternate embodiment, the plate 12 may only include one aperture 14.

Figure 4:
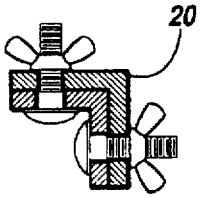
FIG. 4 is a cross-sectional end view of one of the legs at the foot of FIG. 1.

The plate 12 is preferably supported by a frame 16 including a plate supporting skirt 18 and a plurality of legs 20. As illustrated in FIGS. 1 and 4, the legs 20 may be adjustable. The skirt 18 may be formed from lengths of steel angle iron which are preferably arranged so that one leg of each length of angle iron extends under the plate 12 in a supportive relationship. The legs 20 are also preferably formed from lengths of steel angle iron which may be secured to the skirt 18 and/or plate 12 by any conventional and well known manner in the art such as welding, bolting, riveting, etc. The legs 20 may be removable for enhanced portability. Those skilled in the art will appreciate the fact that materials other than steel angle iron and assembly techniques other than welding may be used in the fabrication of the frame 16, if desired. It will be appreciated that in the preferred embodiment that the tool is formed from steel. Alternatively if the tool is to be used in a remote location and weight is a factor, the tool may be fabricated from higher strength alloys or other materials that will reduce the total weight of the overall tool.

Figure 5:
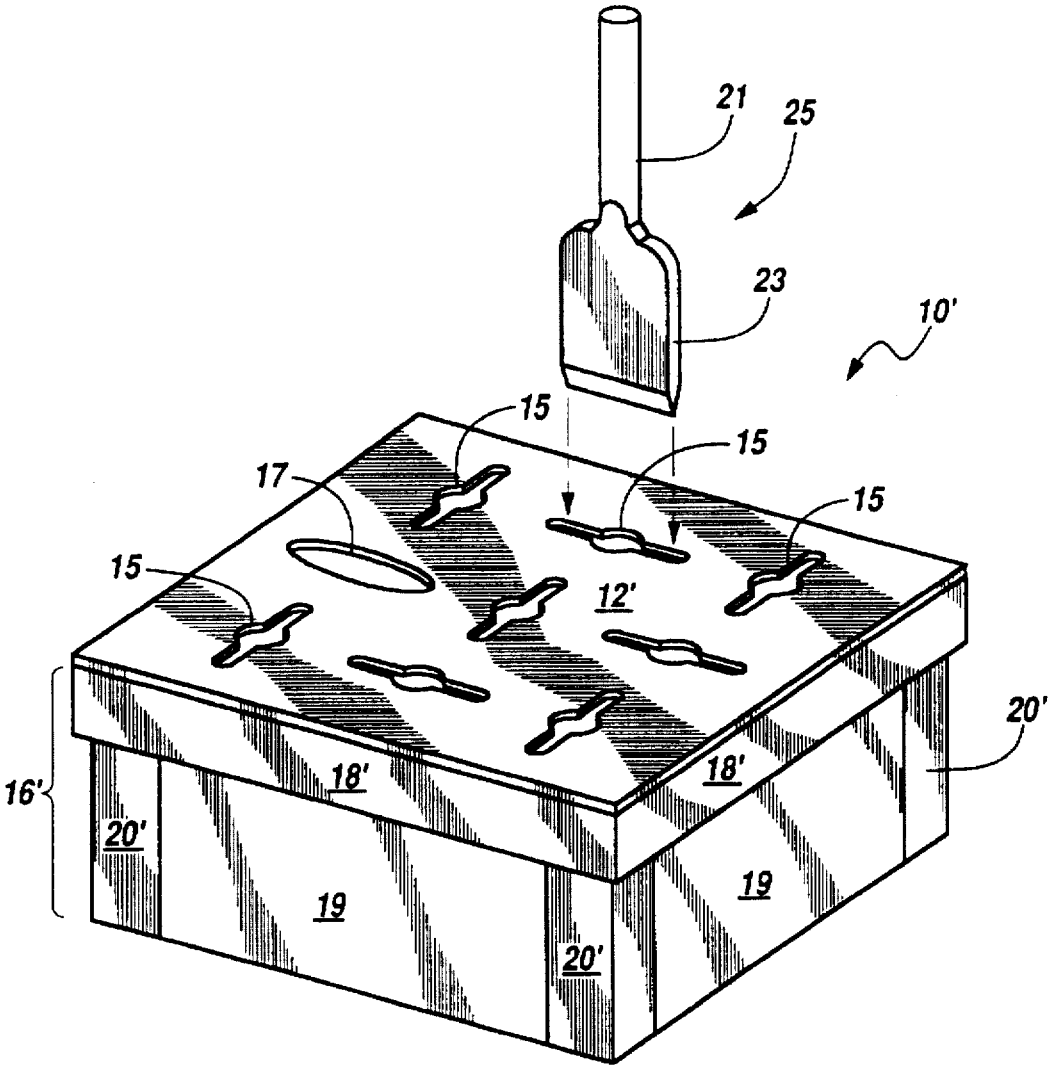
FIG. 5 is a perspective view of an alternate embodiment of the present invention.

Referring now to FIG. 5, an alternative embodiment of the tool 10' is illustrated. Parts with similar structure and function as those in the preferred embodiment of FIGS. 1–4 are indicated by reference numerals with (') designation and are not further described.

In an alternative embodiment, a protective skirt 19 of wood, metal or other durable material may be added to any of the four sides to protect the operator of the tool from stray "fly off" particles.

The aperture 15 comprises a central round opening with two extending generally rectangular openings for receiving a bladed implement 25. The internal diameter of the central opening of aperture 15 is sized to receive and slidably contatct the shaft 21 of implement 25. The rectangular opening of aperture 15 is sized to allow the passage of the blade 23 of implement 25. Alternatively aperture 17 comprises an ellipse, wherein the major axis is sized to allow passage of bladed implement 25 and the minor axis is sized to receive and support the shaft 21 of the implement 25. It will be understood by those skilled in the art that apertures 15 and 17 may have any number of other cross sectional configurations to accomodate tools of varying cross sectional configuration.

Figure 2:
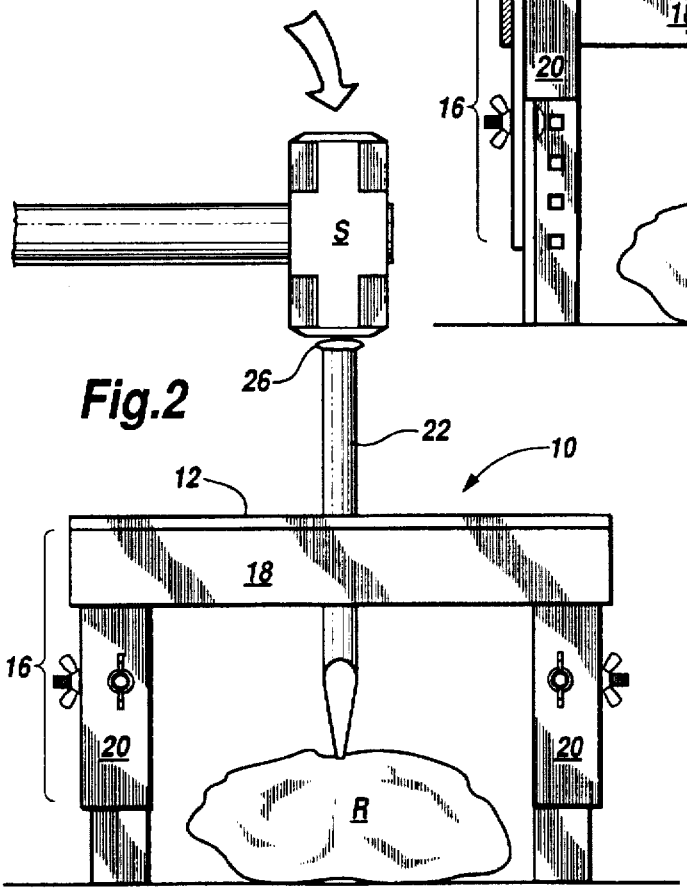
FIG. 2 is a side view of the tool of FIG. 1 showing the tool in use.

Referring now to FIG. 2, the tool of the present invention is illustrated in use. The legs 20 and the skirt 18 of the frame 16 maintain the plate 12 in a substantially horizontal orientation. An implement 22 is positioned through one of the apertures 14 in plate 12 and in engagement with the workpiece or work area (hereinafter "workpiece").

In the embodiment illustrated in FIGS. 1–3 the work piece is depicted as a rock R. It will be understood that the rock R may be projecting from the ground as illustrated herein or alternatively may be at a subsurface level. The tool 10 of the present invention may be useful for excavating holes in rocky ground where a rock is buried underground.

The implement 22 comprises a length of tool steel or similar hard, tough material which may be sharpened. An important feature of the invention 10 comprises the fact that the dimensions and cross sectional configuration of the apertures 14 of the plate 12 are closely matched to the dimensions and exterior configuration of the implement 22. In this manner, the plate 12 functions to maintain the implement 22 in a vertical orientation and precisely in alignment with a selected portion of rock R and/or a similar workpiece. It will be appreciated that the shaft of implement 22 may be of varying lengths to facilitate deeper depressional excavation and that the implement 22 may have an assorted array of head and tip sizes. The head, or striking end, may be larger than the diameter of the shaft on the implement 22 to facilitate striking by the operator. The implement 22 may be formed from tool steel or alternatively from high strength alloys that may increase the implement service life or reduce weight. It will be further appreciated that the implement 22 may have interchangeable tips of various configurations for versatility or for increased implement service life. It will be understood that the tip of the implement 22 may have a configuration larger than aperture 14 as the implement 22 may be inserted into the tool 10 with the striking end first.

In use, the tool 10 is manually positioned to locate the plate 12 in a substantially horizontal orientation above a workpiece such as the rock R. The tool 10 may also be used in conjunction with logs and other workpieces, if desired. The implement 22 is extended though a selected aperture 14 of the plate 12 and is brought into engagement with a selected portion of the workpiece. This causes an end 24 of the implement 22 to engage and act upon the workpiece. After the implement 22 is positioned in contact with the workpiece a sledge hammer S is used to repeatedly strike the end 26 of the implement 12 in a conventional manner, thereby effecting the desired operation on the workpiece. If a different area of the workpiece is to be worked, the implement 22 is simply disengaged from the first aperture 14 of the plate 12 and is then extended through a second selected aperture 14 of the plate 12 and then to engagement with the workpiece, where the foregoing steps are repeated. It will also be understood that a plurality of implements 22 may be used in the tool 10 simultaneously by multiple operators or multiple implements may be used by one operator. In an alternate embodiment (not shown), the tool 10 may have a rectangular configuration which would be especially suited to use by multiple operators for linear trench type excavations. It will be understood by those skilled in the art that an implement may comprise a conventional rock bar wherein the bar is not struck on its proximal end but is positioned in the aperture and raised and dropped one or more times and wherein the falling weight of the bar provides sufficient force to effect the desired result on the workpiece.

As used herein, the term "horizontal" is not necessarily used in the literal sense, but rather to infer a preferred or desired relationship between the plate and the underlying workpiece. For example, if the workpiece is located on the side of a hill, the plate might be inclined at a significant angle relative to true horizontal, but nevertheless substantially parallel to the workpiece. Likewise, as used herein, the term "vertical" is not necessarily used in the literal sense, but rather to infer a substantially perpendicular relationship between the plate and the implement which extends through the holes in the plate. In order that a desirable relationship be established between the plate and the underlying workpiece, one or more of the legs may be selectively adjustable in length in the manner illustrated in FIGS. 1 through 4.

Although preferred and alternate embodiments of the invention have been illustrated in the Drawings and described in the foregoing Detailed Description, it will be understood that the invention is not limited to embodiment disclosed, but is capable of numerous rearrangements, modifications, and changes in the elements without departing from the spirit of the invention.

I claim:

1. A tool for rock breaking, excavating, log splitting and similar operations comprising:

a plate having substantial thickness and having a plurality of substantially identical apertures formed therethrough;

a support for positioning said plate above a workpiece in a substantially horizontal plane;

an implement closely matched in dimensions and cross sectional configuration to the dimensions and cross sectional configuration of said plurality of apertures in said plate, said implement including a first end adapted for engagement with a workpiece and a second end adapted for engagement with a hammer; and wherein said implement may be positioned in a selected aperture in said plate with the first end engaging a predetermined portion of the workpiece and the second end engaged with a hammer.

2. A tool guide for use with an implement having a first end for engaging a workpiece, a second end for being struck with a hammer and a shaft therebetween, said tool guide for use on workpieces in rock breaking, excavating, log splitting and similar operations, said tool guide comprising:

a plate having at least one aperture formed therethrough, said at least one aperture having a predetermined dimension and cross sectional configuration sized to receive and slidably engage the shaft of the implement;

a support for positioning the plate above a workpiece in a substantially horizontal plane; and wherein the implement may be positioned in the aperture in the plate with the first end engaging a predetermined portion of the workpiece and the second end engaged with a hammer.

3. The tool guide of claim 2 further including a protective skirt attached to the support for preventing dislodged portions of the workpiece from striking an operator.

4. The tool guide of claim 2 wherein the aperture is elliptical, said aperture having a major axis sized to allow a bladed implement to pass therethrough and a minor axis sized to slidably engage the shaft of the implement.

5. The tool guide of claim 2 wherein the aperture includes a central circular opening and two opposite generally rectangular openings connected thereto, said central circular opening sized to slidably engage the shaft of the implement said opposing rectangular openings sized to allow a bladed implement to pass therethrough.

6. The tool guide of claim 2 wherein the support includes one or more adjustable legs.

* * * * *